United States Patent [19]

Nishioka

[11] Patent Number: 5,075,994

[45] Date of Patent: Dec. 31, 1991

[54] TRIGGER COVER

[76] Inventor: Jim Z. Nishioka, 1268 Hemlock NW., Salem, Oreg. 97304

[21] Appl. No.: 672,105

[22] Filed: Mar. 19, 1991

[51] Int. Cl.[5] ..... F41A 17/54

[52] U.S. Cl. ..... 42/70.07

[58] Field of Search ..... 42/70.07

[56] References Cited

U.S. PATENT DOCUMENTS

| | | | |
|---|---|---|---|
| 955,237 | 4/1910 | Westcott et al. | 42/70.07 |
| 2,080,202 | 5/1937 | Drake | 42/70.07 |
| 2,525,886 | 10/1950 | Fraser | 42/70.06 |
| 2,590,516 | 3/1952 | De Von Breymann | 42/70.07 |
| 2,709,865 | 6/1955 | Bohenek | 42/70.07 |
| 3,269,046 | 8/1966 | Schaefer | 42/70.07 |
| 3,964,200 | 6/1976 | Patterson | 42/70.06 |
| 4,422,254 | 12/1983 | McQueen | 42/70.05 |
| 5,012,605 | 5/1991 | Nishioka | 42/70.07 |
| 5,024,605 | 6/1991 | Nishioka | 42/70.07 |

FOREIGN PATENT DOCUMENTS

| | | | |
|---|---|---|---|
| 0000117 | 8/1899 | Austria | 42/70.07 |
| 0466668 | 7/1927 | Fed. Rep. of Germany | 42/70.07 |
| 0350867 | 6/1905 | France | 42/70.07 |
| 0004626 | of 1905 | United Kingdom | 42/70.07 |
| 0006761 | of 1910 | United Kingdom | 42/70.07 |

*Primary Examiner*—Michael J. Carone

[57] ABSTRACT

A combination includes a gun and a trigger cover. The gun includes a trigger, a trigger guard and an elongated barrel extending longitudinally in a shooting direction of the gun. The trigger cover includes an open position and a closed position. The open position being for exposing the trigger and allowing access to and operation of the latter. The closed position being for covering and restricting access to the trigger. The cover includes a recess for receiving the trigger in the closed position. The recess faces the trigger in the open position of the cover. A structure extends into the recess when the cover is in the open position.

9 Claims, 1 Drawing Sheet

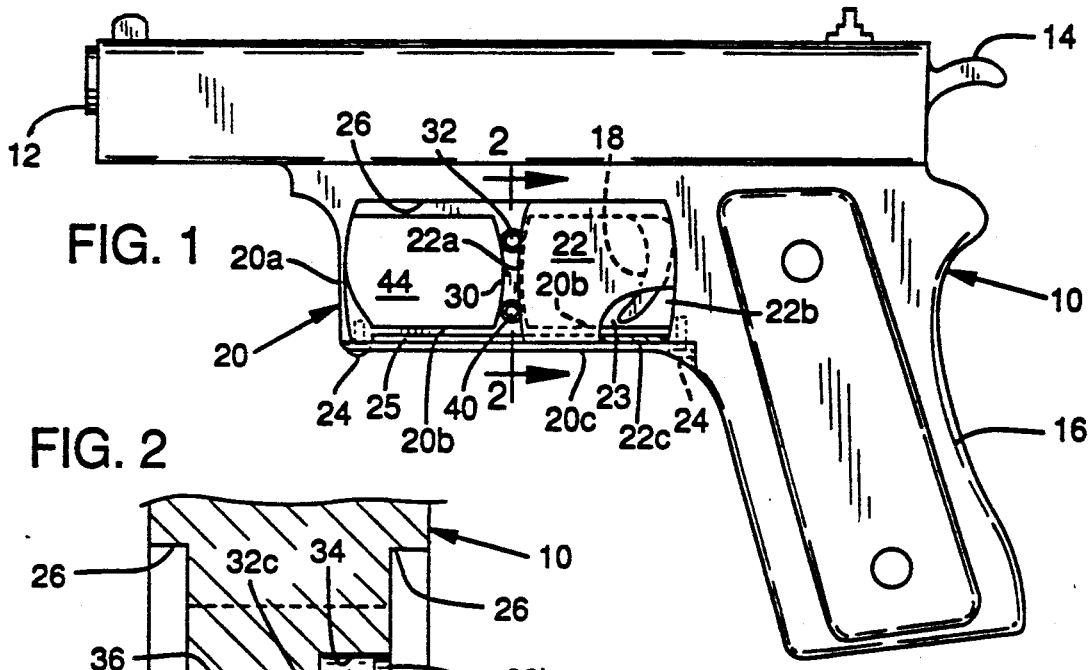
FIG. 1
FIG. 2
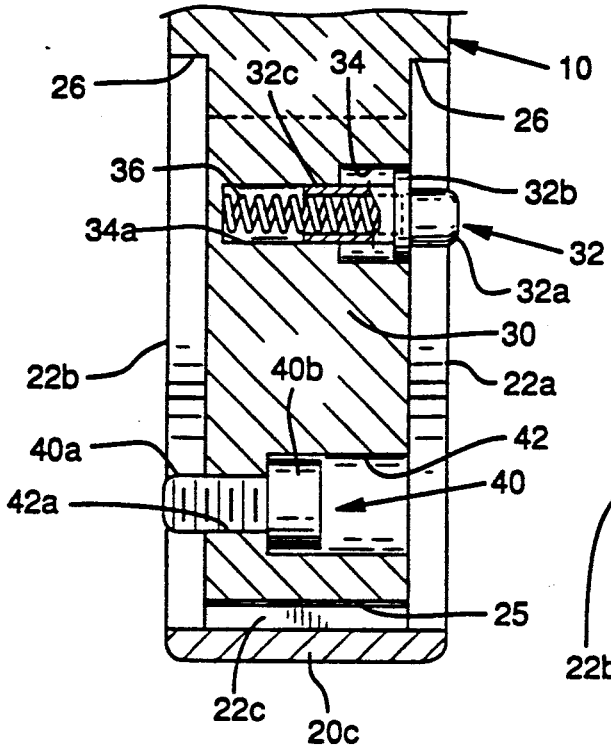
FIG. 4
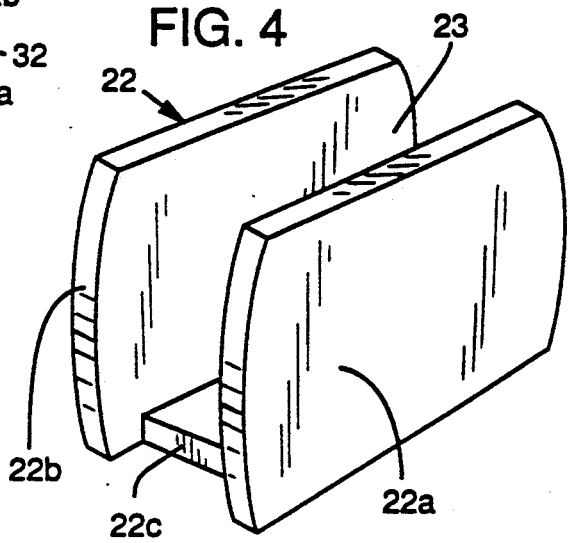
FIG. 3
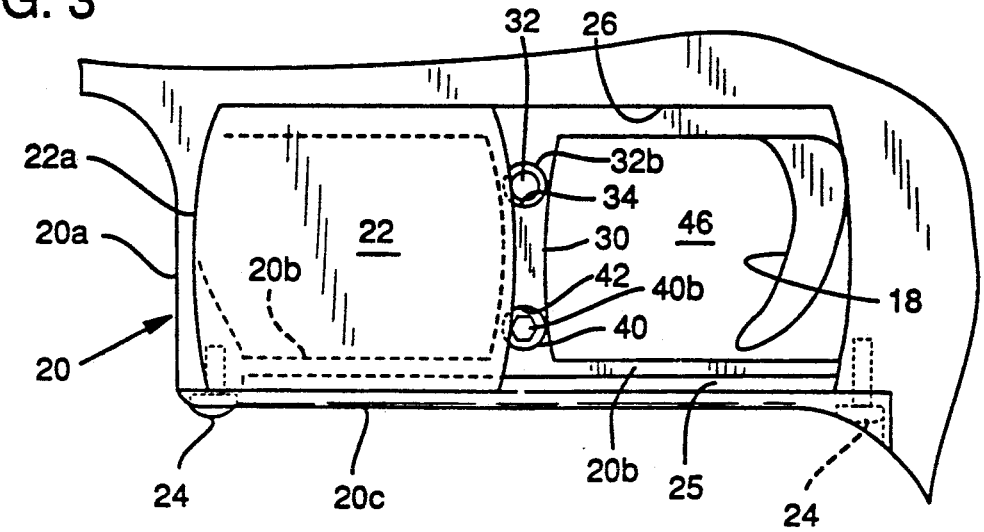

TRIGGER COVER

CROSS REFERENCE

The present application is related to the applicant's U.S. Pat. Nos. 5,012,605 issued May 7, 1991 and 5,024,017 issued June 18, 1991.

BACKGROUND OF THE INVENTION

This invention relates to new and useful improvements in trigger covers for shooting devices such as guns.

SUMMARY OF THE INVENTION

According to the present invention and forming primary objectives thereof, a trigger cover for shooting devices is provided having novel structural arrangements.

Some previous trigger covers are positioned in the trigger guard and have a recess for receiving the trigger in a closed position of such cover. In an open position, the recess is open.

A primary objective of the present invention is to block or restrict the recess when the cover is in the open position. This will block foreign objects from entering the recess and possibly engaging the trigger when the cover is moved to the closed position.

Another objective of this disclosure is to provide a gun with an elongated slot positioned below the trigger for slidably receiving the cover.

Still another objective of this disclosure is to provide a movable portion which will allow easy loading of the cover into the trigger guard.

BRIEF DESCRIPTION OF THE DRAWINGS

FIG. 1 is a side elevational view of a gun and a trigger cover embodying principles of the present invention with the cover in a closed position and partly broken away;

FIG. 2 is an enlarged sectional view taken on line 2—2 of FIG. 1;

FIG. 3 is an enlarged fragmentary side elevational view of the cover and the trigger guard shown in FIG. 1 with the cover in an open position; and FIG. 4 is an enlarged perspective view of the cover.

DETAILED DESCRIPTION OF PREFERRED EMBODIMENTS

With reference to the drawings, a preferred embodiment of the present disclosure embodying principles of the present invention is shown.

A gun 10 includes an elongated barrel 12 which extends longitudinally in a shooting direction of the gun, a hammer 14, a grip 16, a trigger 18 and a trigger guard 20.

A trigger cover 22 is slidably supported in the guard 20. The cover includes a pair of parallel side walls 22*a* and 22*b* and a connecting wall 22*c*. Such connecting wall 22*c* extends longitudinally along the bottom of and between the side walls 22*a* and 22*b*. The cover is preferably constructed of flex-resisting material such as stainless steel, tempered aluminum, rigid plastic or the like.

A recess 23 is that portion of the space between the walls 22*a* and 22*b* which receives the trigger 18 in the closed position of the cover 22. Such recess portion is indicated by 23 in FIG. 4 and also in FIG. 1 with the cover partly broken away.

The cover 22 is shown in the closed position in FIG. 1. In such closed position, the cover covers and restricts access to the trigger 18. In FIG. 3, the cover 22 is shown in the open position. In such open position, the cover allows access to and operation of the trigger.

The cover 22 includes a forward portion which faces in the shooting direction of the gun. Such cover also includes a rearward portion, which in the open position of the cover, faces the trigger.

The guard 20 includes a forward vertical end portion 20*a*. The guard also includes an elongated portion 20*b* which extends longitudinally in the shooting direction of the gun. The guard also includes an elongated plate 20*c* which extends longitudinally under the elongated portion 20*b*. Such elongated plate 20*c* is movable and is detachably secured to the guard by a pair of fasteners 24. The fasteners can be removed to allow the plate 20*c* to be removed from the guard to allow the cover 22 to be loaded into the trigger guard 20.

The fact that the plate 20*c* is movable is a desirable feature of the present disclosure. This feature allows easy loading of unitized or single-piece covers into the trigger guard 20. Such covers are simple and economical to produce and also provide low maintenance operation.

The preferred construction is to employ fasteners 24, best seen in FIG. 3, however, other fastening devices, such as hinges, may be employed to accomplish the same function. Such hinged construction would be movable but not necessarily detachable.

The plate 20*c* is spaced downwardly from the elongated portion 20*b* to form an elongated slot 25 therebetween, best seen in FIG. 3. Such slot is positioned below the trigger 18 and extends longitudinally in the shooting direction of the gun between the front of the trigger guard 20*a* and the trigger. The slot slidably receives the connecting wall 22*c* of the cover 22 and controls its lateral and vertical movements while allowing it to slide between the positions shown in FIGS. 1 and 3. The slot 25 is believed to be a novel and useful feature of this invention.

A pair of grooves 26 in the upper portion of the guard 20, best seen in FIG. 2, receives and stabilizes the top portion of the cover 22 when the latter is moved in the guard. The grooves may be slotted or dove-tailed to receive the top of the cover to resist outwardly pressure.

A structure 30 is positioned in the guard 20 and extends vertically between the top of the guard and the elongated portion 20*b*. Such structure is positioned forwardly of the trigger 18 and rearwardly of the front of the guard 20*a*.

Furthermore, the structure 30 extends rearwardly past the rearward portion of the cover in the open position of the latter. The structure also is positioned above the slot 25. The elongated portion 20*b* extends forwardly of and rearwardly of the structure 30. Such structure and the elongated portion 20*b* are shown as being unitized in this preferred construction, however, they may be constructed as separate pieces.

An important advantage of the present invention over prior disclosures is that, in the open position of the cover 22 shown in FIG. 3, at least a portion of the structure 30 is positioned in the recess 23. Such recess, as previously mentioned, being the space in the cover for receiving the trigger 18 in the closed position of such cover.

In the open position of the cover 22, the structure 30 blocks or restricts foreign objects, such as twigs, mud or the like from entering or lodging in the recess 23 and possibly engaging the trigger 18 when the cover is moved from the open position shown in FIG. 3 to the closed position shown in FIG. 1. This blocking action of the structure 30 is a desirable feature of this disclosure.

In the open position of the cover 22, shown in FIG. 3, the recess 23 faces the trigger with the structure 30 being positioned in such recess. Furthermore, in the open position of the cover, the structure 30 extends rearwardly beyond the recess 23 and the vertical walls 22*a* and 22*b* of the cover 22.

The structure 30 supports a holding device 32, best seen in FIG. 2, for holding the cover 22 in either the closed position shown in FIG. 1 or in the open position shown in FIG. 3. The holding device includes a pressure receiving portion 32*a* for receiving an operator pressure to release the holding device and allowing movement of the cover. Such portion 32*a* engages the side wall 22*a* of the cover 22 in the hold position. This can be seen in FIG. 2.

The holding device 32 also includes a flange-like portion 32*b* which engages the parallel side wall 22*a* of the cover 22. The flange-like portion retains the holding device in a bore 34 in the structure 30. The bore allows the flange portion 32*b* to move when the device is depressed against a resistance of a spring 36. The holding device also includes a hollow barrel portion 32*c*, partly broken away, which receives the spring 36. The bore 34 includes a portion 34*a* for slidably receiving and guiding the barrel portion 32*c* of the device 32.

The structure 30 also supports a locking device 40, best seen in FIG. 2, which includes a threaded portion 40*a* and an opposite end portion which includes a tool receiving portion 40*b*. Such tool receiving portion is best seen in FIG. 3. The locking device can be activated by a tool such as an allen wrench or a key. A bore 42 receives the locking device 40 and includes a threaded portion 42*a* to correspond to the threaded portion 40*a* of the locking device.

It can be seen that when a tool is inserted in the tool receiving portion 40*b* and the device 40 is rotated, it will cause the threaded portion 40*a* to extend beyond the structure 30 and lock the cover 22. By reversing the rotation of the locking device, such device will retract into the bore 42 and allow the cover to be moved.

The holding device 32 shown in FIG. 2 will hold the cover automatically when the latter is open or closed, whereas, the locking device requires a tool and is more difficult for an unauthorized person to release.

In the closed position of the cover 22, the forward edge of such cover is positioned rearwardly of the holding device 32 and the locking device 40, best seen in FIG. 1. In the open position of the cover, the rearward edge of such cover is positioned forwardly of the holding device and the locking device, best seen in FIG. 3. This feature eliminates the need for openings in the sides or the bottom of the cover to gain access to the holding device or the locking device. This feature also simplifies construction of the cover.

The structure 30, the holding device 32 and the locking device 40 are positioned in the approximate center of the front to back dimension of the trigger guard 20 for easy access and visibility.

The guard 20 includes a pair of openings to allow the operator's fingers to enter such guard. The openings are indicated by 44 in FIG. 1 and by 46 in FIG. 3. The opening 46 is positioned rearwardly of the structure 30. This opening allows operator access to the trigger 18 when the cover 22 is in the open position shown in FIG. 3.

The opening 44, seen in FIG. 1, is positioned forwardly of the structure 30 and is formed by the front of the guard 20*a* and such structure. Both of the openings 44 and 46 are positioned forwardly of the trigger 18. In the closed position of the cover, the opening 44 allows the operator to insert his finger into the guard 20 for easy carrying. A further advantage of the opening 44 is that it reduces weight.

While the above description contains many specifics, the reader should not consteue these as limitations on the scope of the invention, but merely as examples of the preferred embodiments thereof. Alternate constructions and modifications include the following:

An alternate construction would be to eliminate the elongated portion 20*b* forwardly of, rearwardly of and under the structure 30. The structure, therefore, would be spaced above and apart from the elongated plate 20*c*. This would allow the connecting wall 22*c* of the cover 22 to slide under the structure. The plate 20*c* would be provided with an elongated rib which would extend longitudinally along the top of such plate. The top of the wall 22*c* would include a raised portion to form a groove in the bottom of such wall 22*c* to receive the elongated rib on the plate 20*c*. The engagement of the rib with the groove would control lateral movements of the cover while allowing such cover to slide between the positions shown in FIGS. 1 and 3. Furthermore, the bottom of the structure 30 would be provided with an elongated groove to correspond to the elongated raised portion of the cover. Such an arrangement would restrict or block foreign objects from entering the trigger receiving portion 23 of the rearward portion of the cover when the latter is in the open position.

Another alternate construction is that the front to back dimension of the structure 30 may be reduced or increased. Furthermore, such structure may be dished, bored, slotted or the like to reduce weight and material. With such modifications, the structure would still accomplish the function of blocking foreign objects from entering the recess 23 in the open position of the cover 22. Still another alternate construction or modification would be to provide the walls 22*a* and 22*b* with engravings, logos or the like.

Accordingly, the scope of this invention should be determined not by the embodiment illustrated, but by the appended claims and their legal equivalents.

Having thus described my invention, I claim:

1. In combination, a gun and a trigger cover, said gun having a trigger, a trigger guard and an elongated barrel extending longitudinally in a shooting direction of the gun, said trigger cover for covering said trigger, said trigger cover including an open position and a closed position, said open position being a position of said trigger cover for exposing said trigger and allowing access to and operation of the latter, said closed position being a position of said trigger cover for covering and restricting access to said trigger, said trigger cover also including forward and rearward portions, said trigger cover being slidably connected to said gun during operation of said combination, said cover including recess means, said recess means being space in said cover for receiving said trigger in said closed position of said cover, said recess means being positioned in said rearward portion of said cover and facing said trigger in said open position of said cover, said combination also including blocking means for blocking foreign objects from entering said recess means when said cover is in said open position.

2. The combination of claim 1 wherein said blocking means extends rearwardly beyond said recess means when said cover is in the open position facing said trigger.

3. The combination of claim 1 wherein said blocking means is vertically positioned in said trigger guard.

4. The combination of claim 1 wherein said trigger guard includes a forward portion, said blocking means being positioned rearwardly of said forward portion of said trigger guard and forwardly of said trigger.

5. In combination, a gun and a trigger cover, said gun having a trigger, a trigger guard and an elongated barrel extending longitudinally in a shooting direction of the gun, said trigger cover for covering said trigger, said trigger cover including an open position and a closed position, said open position being a position of said trigger cover for exposing said trigger and allowing access to and operation of the latter, said closed position being a position of said trigger cover for covering and restricting access to said trigger, said trigger cover also including forward and rearward portions, said trigger cover being connected to said gun during operation of said combination, said trigger cover including a pair of opposite parallel side walls and a connecting wall positioned therebetween for connecting said pair of side walls, said gun also including slot means positioned below said trigger and extending longitudinally in the shooting direction of the gun, said slot means for slidably receiving said connecting wall of said cover and for controlling vertical and lateral movements of said cover during operation of the latter.

6. The combination of claim 5 wherein said trigger guard includes a forward end, said slot means extending rearwardly from said forward end of said trigger guard to said trigger.

7. In combination, a gun and a trigger cover, said gun having a trigger, a trigger guard and an elongated barrel extending longitudinally in a shooting direction of the gun, said trigger cover for covering said trigger, said trigger cover including an open position and a closed position, said open position being a position of said trigger cover for exposing said trigger and allowing access to and operation of the latter, said closed position being a position of said trigger cover for covering and restricting access to said trigger, said trigger cover also including forward and rearward portions, said trigger cover being connected to said gun during operation of said combination, said gun including loading means for loading said cover into said trigger guard, said loading means including a movable portion for allowing easy loading of said cover into said trigger guard.

8. The combination of claim 7 wherein said movable portion slidably supports said cover during operation of the latter.

9. The combination of claim 7 wherein said movable portion is elongated and extends longitudinally in the shooting direction of the gun.

* * * * *